US008405590B2

(12) United States Patent
Park et al.

(10) Patent No.: US 8,405,590 B2
(45) Date of Patent: Mar. 26, 2013

(54) LIQUID CRYSTAL DISPLAY AND METHOD OF MODIFYING IMAGE SIGNAL FOR SHORTER RESPONSE TIME

(75) Inventors: Bong-Im Park, Cheonan-si (KR); Bong-Ju Jun, Suwon-si (KR)

(73) Assignee: Samsung Display Co., Ltd. (KR)

( * ) Notice: Subject to any disclaimer, the term of this patent is extended or adjusted under 35 U.S.C. 154(b) by 1387 days.

(21) Appl. No.: 11/502,910

(22) Filed: Aug. 11, 2006

(65) Prior Publication Data

US 2007/0046597 A1 Mar. 1, 2007

(30) Foreign Application Priority Data

Aug. 12, 2005 (KR) ..... 10-2005-0074344

(51) Int. Cl.
*G09G 3/36* (2006.01)
*G09G 5/10* (2006.01)

(52) U.S. Cl. ..... 345/89; 345/690; 345/87; 345/88

(58) Field of Classification Search ..... 345/87–89, 345/690

See application file for complete search history.

(56) References Cited

U.S. PATENT DOCUMENTS

2003/0151579 A1 8/2003 Lee
2004/0246220 A1 12/2004 Cheon
2005/0062703 A1* 3/2005 Lee et al. ..... 345/89

FOREIGN PATENT DOCUMENTS

CN 1603902 A 4/2005
JP 2005-062868 A 3/2005
JP 2005-141216 A 6/2005
KR 10-2005-0017903 A 2/2005
KR 1020050041463 A 5/2005

* cited by examiner

*Primary Examiner* — Sumati Lefkowitz
*Assistant Examiner* — David Tung
(74) *Attorney, Agent, or Firm* — Innovation Counsel LLP

(57) ABSTRACT

A liquid crystal display with improved response time and a method of making such display are presented. The invention improves the quality of moving images. The display includes a plurality of pixels, an image signal modifier for generating a preliminary signal based on a previous image signal and a current image signal and generating a modified image signal based on the preliminary signal and a next image signal, and a data driver for changing the modified image signal from the image signal modifier into a data voltage and supplying it to the pixels. The value of the modified image signal is set according to the magnitude of the next image signal.

14 Claims, 9 Drawing Sheets

LIQUID CRYSTAL DISPLAY AND METHOD OF MODIFYING IMAGE SIGNAL FOR SHORTER RESPONSE TIME

CROSS-REFERENCE TO RELATED APPLICATION

This application claims priority to and the benefit of Korean Patent Application No. 10-2005-0074344 filed in the Korean Intellectual Property Office on Aug. 12, 2005, the entire content of which is incorporated herein by reference.

BACKGROUND OF THE INVENTION (a) Field of the Invention

The present invention relates to a liquid crystal display and a method of modifying of an image signal.

(b) Description of Related Art

Liquid crystal displays (LCDs) include a pair of panels provided with field generating electrodes and a liquid crystal (LC) layer having dielectric anisotropy that is disposed between the two panels. The field generating electrodes generally include a plurality of pixel electrodes arranged in a matrix and connected to switching elements such as thin film transistors (TFTs), and a common electrode covering the entire surface of a panel and supplied with a common voltage. The field generating electrodes generate an electric field in response to applied voltages and liquid crystals disposed therebetween form a so-called liquid crystal capacitor. The liquid crystal capacitor is a basic element of a pixel along with a switching element.

The LCD applies voltages to the field generating electrodes to generate an electric field in the liquid crystal layer, and the strength of the electric field can be controlled by adjusting the voltage across the liquid crystal capacitor. Since the electric field determines the orientations of liquid crystal molecules and the molecular orientations determine the transmittance of light through the liquid crystal layer, light transmittance is adjusted by controlling the applied voltages to obtain desired images.

In order to prevent image deterioration due to long-time application of the unidirectional electric field, etc., polarity of the data voltages with respect to the common voltage is reversed every frame, every row, or every pixel.

As the LCD is increasingly used for displaying moving images, its slow response time has been receiving attention as a characteristic that needs improvement. The improvement in response time becomes even more desirable as the size and resolution of the display devices increase, creating even more of a delay in response time.

To compensate for the slow response speed, a method of applying a data voltage that is larger or smaller than a data voltage of an input image signal (i.e., an overshoot voltage or an undershoot voltage) to the pixel electrode has been suggested.

However, to apply the overshoot voltage when the LCD is in a normally black mode, and when the overshoot voltage corresponds to the maximum gray voltage, the data voltage corresponding to a white gray should be lower than the maximum gray voltage. Therefore, luminance of the LCD decreases.

SUMMARY OF THE INVENTION

In one aspect, the invention is a liquid crystal display that includes a plurality of pixels; an image signal modifier, and a data driver. The image signal modifier generates a preliminary signal based on a previous image signal and a current image signal and generates a modified image signal based on the preliminary signal and a next image signal. The data driver changes the modified image signal from the image signal modifier into a data voltage and supplies it to the pixels. The modified image signal is selected from at least two different values according to a magnitude of the next image signal.

In another aspect, the invention is a method of modifying an image signal of a liquid crystal display. The method includes reading a previous image signal, a current image signal, and a next image signal, generating a preliminary signal based on the previous image signal and the current image signal, and generating a modified image signal based on the preliminary signal and the next image signal. The modified image signal has at least two different values depending to a magnitude of the next image signal.

BRIEF DESCRIPTION OF THE DRAWINGS

The accompanying drawings briefly described below illustrate exemplary embodiments of the present invention, and together with the description, serve to explain the principles of the present invention.

DETAILED DESCRIPTION OF EMBODIMENTS

Figure 1:
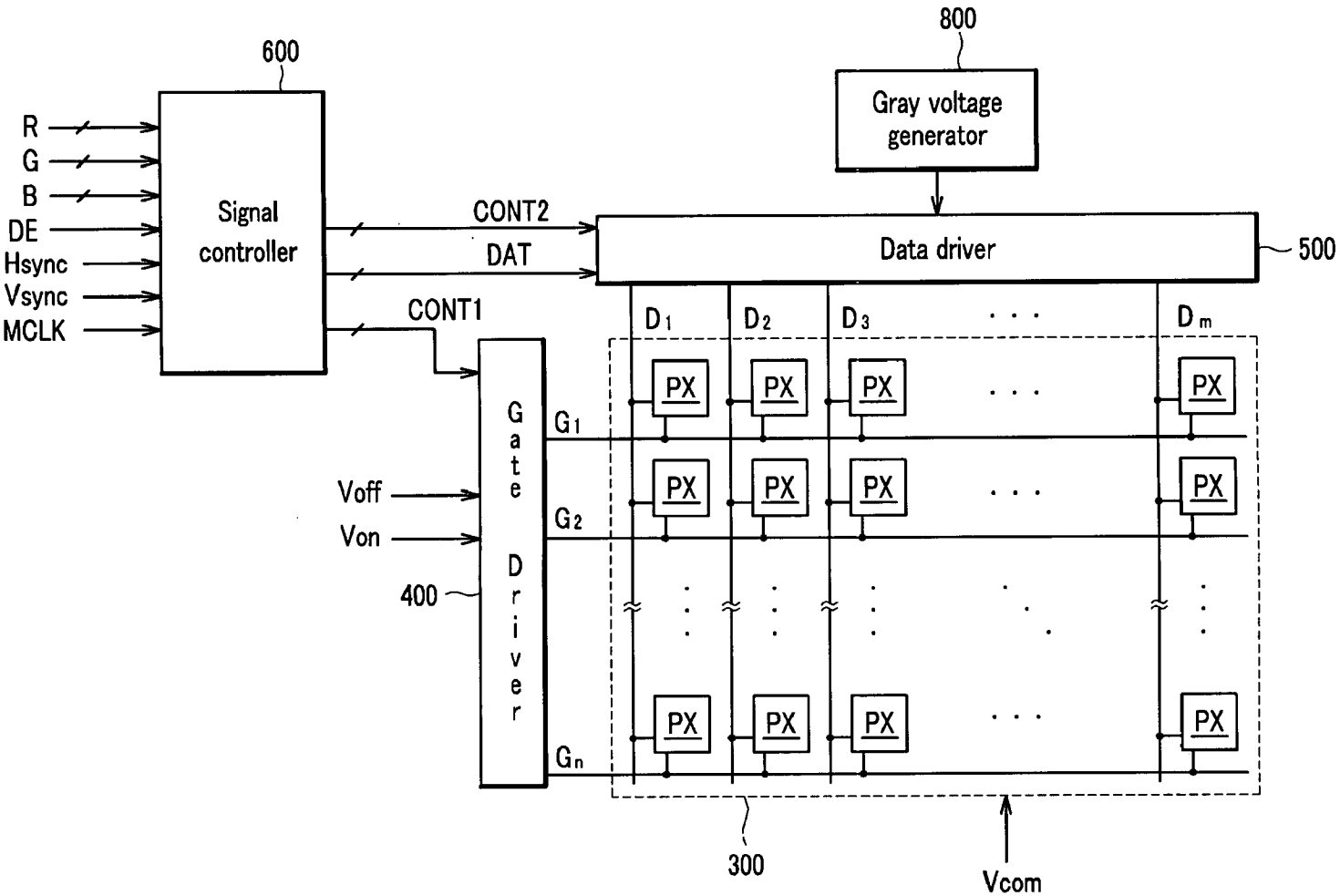
FIG. 1 is a block diagram of an LCD according to an embodiment of the present invention.

The present invention will be described more fully hereinafter with reference to the accompanying drawings, in which preferred embodiments of the invention are shown.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present.

Liquid crystal displays according to embodiments of the present invention will now be described with reference to FIGS. 1 and 2.

Figure 2:
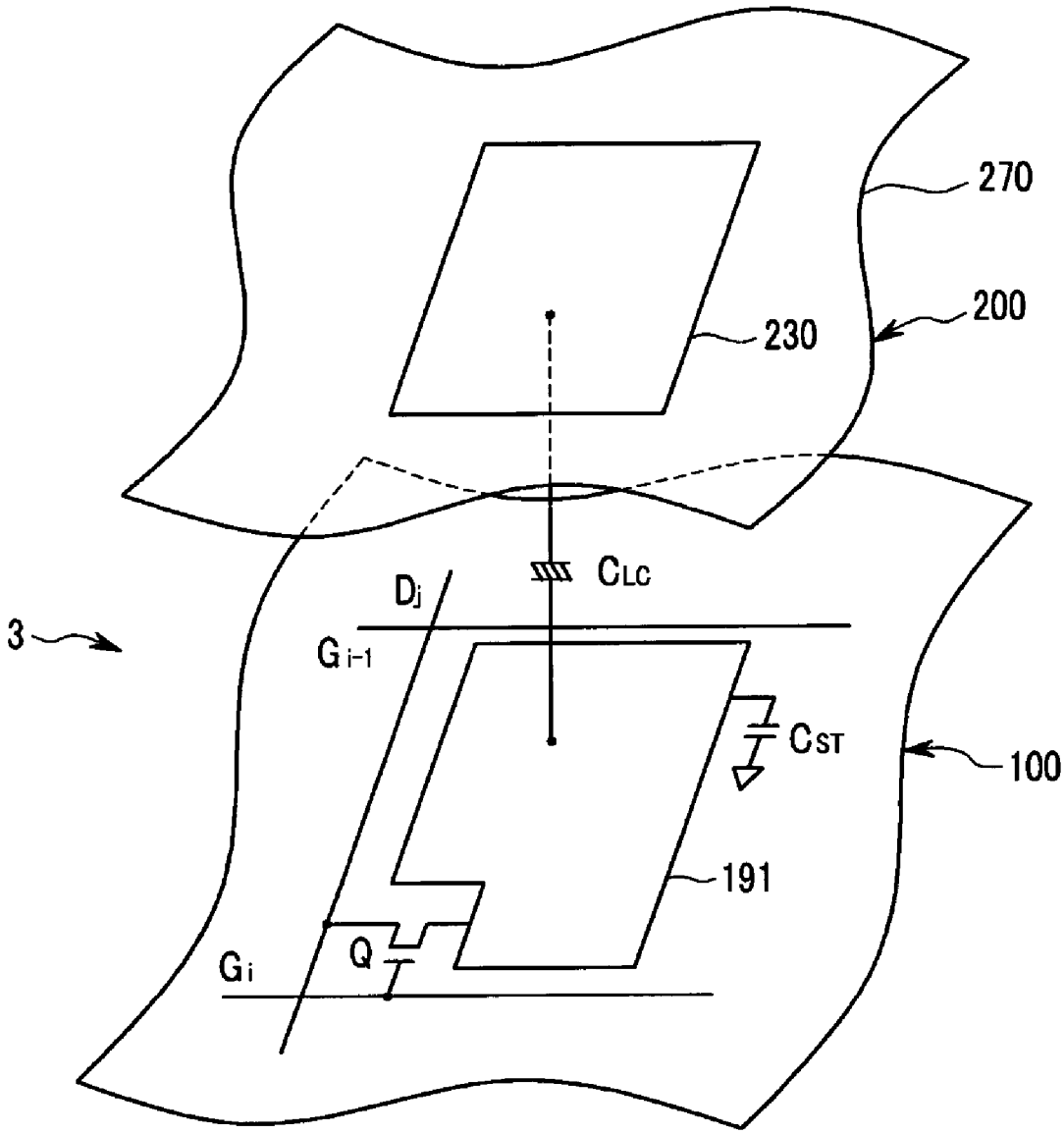
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment of the present invention includes an LC panel assembly 300, a gate driver 400 and a data driver 500 connected thereto, a gray voltage generator 800 connected to the data driver 500, and a signal controller 600 for controlling the above-described elements.

The LC panel assembly 300, in a structural view shown in FIG. 2, includes a lower panel 100, an upper panel 200, and a liquid crystal layer 3 interposed therebetween, and it further includes a plurality of signal lines $G_1$-$G_n$ and $D_1$-$D_m$ and a plurality of pixels PX connected thereto and arranged substantially in a matrix as shown in FIGS. 1 and 2.

The signal lines $G_1$-$G_n$ and $D_1$-$D_m$ are provided on the lower panel 100 and include a plurality of gate lines $G_1$-$G_n$ for transmitting gate signals (called scanning signals) and a plurality of data lines $D_1$-$D_m$ for transmitting data signals. The gate lines $G_1$-$G_n$ extend substantially in a first direction and are substantially parallel to each other, while the data lines $D_1$-$D_m$ extend substantially in a second direction and are substantially parallel to each other. The first direction and the second direction are substantially perpendicular to each other.

Referring to FIG. 2, each pixel PX, for example, a pixel PX in the i-th row (i=1, 2, . . . , n) and the j-th column (j=1, 2, . . . , m), is connected to signal lines $G_1$ and $D_j$ and includes a switching element Q connected to the signal lines $G_1$-$G_n$ and $D_1$-$D_m$, and an LC capacitor $C_{LC}$ and a storage capacitor $C_{ST}$ that are connected to the switching element Q. The storage capacitor $C_{ST}$ may be omitted in some embodiments.

The switching element Q such as a TFT is provided on the lower panel 100, and has three terminals: a control terminal connected to one of the gate lines $G_1$-$G_n$; an input terminal connected to one of the data lines $D_1$-$D_m$; and an output terminal connected to the LC capacitor $C_{LC}$ and the storage capacitor $C_{ST}$.

The LC capacitor $C_{LC}$ includes a pixel electrode 191 provided on the lower panel 100 and a common electrode 270 provided on the upper panel 200, as two terminals. The LC layer 3 disposed between the two electrodes 191 and 270 functions as a dielectric of the LC capacitor $C_{LC}$. The pixel electrode 191 is connected to the switching element Q, and the common electrode 270 is supplied with a common voltage Vcom and covers an entire surface of the upper panel 200. Unlike in FIG. 2, the common electrode 270 may be provided on the lower panel 100, and both electrodes 191 and 270 may be shaped into bars or stripes.

The storage capacitor $C_{ST}$ is an auxiliary capacitor for the LC capacitor $C_{LC}$. The storage capacitor $C_{ST}$ includes the pixel electrode 191 and a separate signal line (not shown) that is provided on the lower panel 100 and overlaps the pixel electrode 191 via an insulator. The signal line is supplied with a predetermined voltage such as the common voltage Vcom. Alternatively, the storage capacitor $C_{ST}$ includes the pixel electrode 191 and an adjacent gate line (herein called a previous gate line) that overlaps the pixel electrode 191 via an insulator.

Color display can be achieved in different methods. With the spatial division method, each pixel PX represents one primary color. With the temporal division method, each pixel PX sequentially represents the primary colors in turn. In each case, a spatial or temporal sum of the primary colors is recognized as the desired color. A common of a set of primary colors includes red, green, and blue although other combinations that produce a range of desired colors is possible. FIG. 2 shows an example of the spatial division in which each pixel PX includes a color filter 230 representing one of the primary colors in an area of the upper panel 200 facing the pixel electrode 191. Alternatively, the color filter 230 is provided on or under the pixel electrode 191 on the lower panel 100.

One or more polarizers (not shown) are attached to at least one of the panels 100 and 200.

Referring to FIG. 1 again, the gray voltage generator 800 generates two sets of a plurality of gray voltages (or reference gray voltages) related to the transmittance of light through the pixels PX. The gray voltages in one set have a positive polarity with respect to the common voltage Vcom, while those in the other set have a negative polarity with respect to the common voltage Vcom.

The gate driver 400 is connected to the gate lines $G_1$-$G_n$ of the panel assembly 300 and synthesizes the gate-on voltage Von and the gate-off voltage Voff from an external device to generate gate signals for application to the gate lines $G_1$-$G_n$.

The data driver 500 is connected to the data lines of the panel assembly 300 and applies data voltages, which are selected from the gray voltages supplied by the gray voltage generator 800, to the data lines $D_1$-$D_m$. In some embodiments, the data driver 500 generates gray voltages for all the grays by dividing the reference gray voltages. In these embodiments, the data driver 500 selects the data voltages from the generated gray voltages when the gray voltage generator 800 generates reference gray voltages.

The signal controller controls the gate driver 400 and the data driver 500.

Each of the processing units 400, 500, 600, and 800 may include at least one integrated circuit (IC) chip mounted on the LC panel assembly 300 or on a flexible printed circuit (FPC) film as a tape carrier package (TCP) type, which are attached to the panel assembly 300. Alternatively, at least one of the processing units 400, 500, 600, and 800 may be integrated with the panel assembly 300 along with the signal lines and the switching elements Q. As a further alternative, all the processing units 400, 500, 600, and 800 may be integrated into a single IC chip but at least one of the processing units 400, 500, 600, and 800 or at least one circuit element of at least one of the processing units 400, 500, 600, and 800 may be disposed outside of the single IC chip.

Now, the operation of the LCD will be described in detail.

The signal controller 600 is supplied with input image signals R, G, and B and input control signals for controlling the display from an external graphics controller (not shown). The input image signals R, G, and B contain luminance information of each pixel PX, and the luminance has a predetermined number of, for example 1024 ($=2^{10}$), 256 ($=2^8$), or 64 ($=2^6$) grays. The input control signals include a vertical synchronization signal Vsync, a horizontal synchronization signal Hsync, a main clock signal MCLK, a data enable signal DE, etc.

After generating gate control signals CONT1 and data control signals CONT2 and processing the image signals R, G, and B to be suitable for the operation of the panel assembly 300 on the basis of the input control signals and the input image signals R, G, and B, the signal controller 600 transmits the gate control signals CONT1 to the gate driver 400, and the processed image signals DAT and the data control signals CONT2 to the data driver 500. The output image signals DAT are digital signals and have values (or grays) of the predetermined number.

The gate control signals CONT1 include a scanning start signal STV for instructing to start scanning, and at least one clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing the start of data transmission for a group of pixels PX, a load signal LOAD for instructing to apply the data voltages to the data lines $D_1$-$D_m$, and a data clock signal HCLK. The data control signal CONT2 may further include an inversion signal RVS for reversing the polarity of the data voltages (with respect to the common voltage Vcom).

Responsive to the data control signals CONT2 from the signal controller 600, the data driver 500 receives a packet of the image data DAT for the group of pixels PX from the signal controller 600 and receives the gray voltages supplied by the gray voltage generator 800. The data driver 500 converts the image data DAT into analog data voltages selected from the gray voltages supplied by the gray voltage generator 800, and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on the switching elements Q connected thereto. The data voltages applied to the data lines $D_1$-$D_m$ are supplied to the pixels PX through the activated switching elements Q.

A difference between the data voltage and the common voltage Vcom is represented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) converts light polarization into light transmittance such that the pixels PX display the luminance represented by the gray of the image data DAT.

By repeating this procedure by a unit of a horizontal period (which is denoted by "1H" which is equal to one period of the horizontal synchronization signal Hsync and the data enable signal DE), all gate lines $G_1$-$G_n$ are sequentially supplied with the gate-on voltage Von during a frame, thereby applying the data voltages to all pixels PX.

When the next frame starts after one frame finishes, the inversion control signal RVS applied to the data driver 500 is controlled such that the polarity of the data voltages is reversed (this scheme is referred to as "frame inversion"). Depending on the embodiment, the inversion control signal RVS may also be controlled such that the polarity of the data voltages flowing in a data line in one frame is reversed during one frame (for example, line inversion and dot inversion), or the polarity of the data voltages in one packet is reversed (for example, column inversion and dot inversion).

The voltage across the LC capacitor $C_{LC}$ forces the LC molecules in the LC layer 3 to be reoriented into a stable state corresponding to the voltage, and the reorientation of the LC molecules takes a certain amount of time since the response time of the LC molecules is slow. The LC molecules continue to reorient themselves, thereby varying the light transmittance, until they reach the stable state for the voltage across the LC capacitor $C_{LC}$ that is maintained. When the LC molecules reach the stable state and stop reorienting themselves, the light transmittance level becomes fixed.

When a pixel voltage in such a stable state is referred to as the target pixel voltage and the light transmittance level in the stable state is referred to as the target light transmittance level, the target pixel voltage and the target light transmittance level correlate to each other.

Since the switching element Q is turned on and a data voltage is applied to the pixel for a limited duration, it is difficult for the LC molecules in the pixel PX to reach a stable state during the application of the data voltage. However, even though the switching element Q is turned off, the voltage still exists across the LC capacitor $C_{LC}$ and the LC molecules continue reorienting themselves such that the capacitance of the LC capacitor $C_{LC}$ changes. Ignoring leakage current, the total amount of electrical charges stored in the LC capacitor $C_{LC}$ is kept constant when the switching element Q turns off since one terminal of the LC capacitor $C_{LC}$ is floating. Therefore, the variation of the capacitance of the LC capacitor $C_{LC}$ results in the variation of the voltage across the LC capacitor $C_{LC}$, i.e., the pixel voltage.

Consequently, when a pixel PX is supplied with a data voltage corresponding to the target pixel voltage (referred to as a "target data voltage" hereinafter), which is determined in the stable state, an actual pixel voltage of the pixel PX may be different from the target pixel voltage such that the pixel PX may not reach the target light transmittance level. The difference between the actual pixel voltage and the target pixel voltage correlates with the difference between the target transmittance level and the actual light transmittance level through the pixel PX.

Accordingly, a data voltage applied to the pixel PX is required to be higher or lower than the target data voltage. There are a number of ways in which this may be realized, such as by using DCC (dynamic capacitance compensation).

According to an embodiment of the present invention, DCC, which may be performed by the signal controller 600 or a separate image signal modifier, modifies an image signal of a frame (referred to as a "current image signal" hereinafter) $g_N$ for a pixel to generate a modified current image signal (referred to as a "first modified image signal" hereinafter) $g_N'$ based on an image signal of an immediately previous frame (referred to as a "previous image signal" hereinafter) $g_{N-1}$ for the pixel. The first modified image signal $g_N'$ is basically obtained by experiments, and the difference between the first modified current image signal $g_N'$ and the previous image signal $g_{N-1}'$ is usually larger than the difference between the current image signal $g_N$ before modification and the previous image signal $g_{N-1}'$. However, when the current image signal $g_N$ and the previous image signal $g_{N-1}'$ are equal to each other or the difference between them is small, the first modified image signal $g_N'$ may be equal to the current image signal $g_N$ (that is, the current image signal may not be modified).

The first modified image signal $g_N'$ may be represented as a function F1 of Equation 1.

$$g_N' = F1(g_N, g_{N-1}) \quad \text{[Equation 1]}$$

Accordingly, the data voltage applied from the data driver 500 to each pixel PX is larger or smaller than the target data voltage.

TABLE 1

Exemplary Modified Image Signals for $g_N$ and $g_{N-1}$ Pairs

| | | $g_{N-1}$ | | | | | | | | |
|---|---|---|---|---|---|---|---|---|---|---|
| | | 0 | 32 | 64 | 96 | 128 | 160 | 192 | 224 | 255 |
| $g_N$ | 0 | 0 | 0 | 0 | 0 | 0 | 0 | 0 | 0 | 0 |
| | 32 | 115 | 32 | 22 | 20 | 15 | 15 | 15 | 15 | 15 |
| | 64 | 169 | 103 | 64 | 50 | 34 | 27 | 22 | 20 | 16 |

TABLE 1-continued

Exemplary Modified Image Signals for $g_N$ and $g_{N-1}$ Pairs

| | $g_{N-1}$ | | | | | | | | |
|---|---|---|---|---|---|---|---|---|---|
| | 0 | 32 | 64 | 96 | 128 | 160 | 192 | 224 | 255 |
| 96 | 192 | 146 | 118 | 96 | 87 | 70 | 54 | 36 | 29 |
| 128 | 213 | 167 | 156 | 143 | 128 | 121 | 105 | 91 | 70 |
| 160 | 230 | 197 | 184 | 179 | 174 | 160 | 157 | 147 | 129 |
| 192 | 238 | 221 | 214 | 211 | 205 | 199 | 192 | 187 | 182 |
| 224 | 250 | 245 | 241 | 240 | 238 | 238 | 224 | 224 | 222 |
| 255 | 255 | 255 | 255 | 255 | 255 | 255 | 255 | 255 | 255 |

Table 1 shows exemplary modified image signals for some pairs of previous image signals $g_{N-1}$ and current image signals $g_N$ in a 256 gray system.

This image signal modification requires a storage such as a frame memory for storing the previous image signals $g_{N-1}$. In addition, a lookup table is necessary to store data shown in TABLE 1.

Since the size of a lookup table for containing the first modified image signals $g_n'$ for all pairs of current and previous image signals $g_{N-1}$ and $g_N$ may be tremendous, it is preferable, for example, to store the first modified image signals $g_N'$ for some pairs of previous and current image signals $g_{N-1}$ and $g_N$. For example, the first modified image signals $g_N'$ shown in TABLE 1 may be stored as reference modified signals. The first modified image signals $g_N'$ for the remaining pairs of previous and current image signals $g_{N-1}$ and $g_N$ may be obtained by interpolation. The interpolation of a pair of previous and current image signals $g_{N-1}$ and $g_N$ is to find the first modified image signals $g_N'$ for pairs of previous and current image signals $g_{N-1}$ and $g_N$ close to the signal pair in TABLE 1, and to calculate the first modified signal $g_N'$ for a $g_N$-$g_{N-1}$ signal pair based on the modified signals stored in the lookup table.

In an exemplary embodiment, each image signal that is a digital signal is divided into MSBs (most significant bits) and LSBs (least significant bits), and the lookup table stores reference modified signals for the pairs of previous and current image signals $g_{N-1}$ and $g_N$ having zero as their LSBs. For a pair of previous and current image signals $g_{N-1}$ and $g_N$, some reference modified image signals associated with MSBs of the signal pair are found. A first modified image signal $g_N'$ for the signal pair is calculated from the LSBs of the signal pair and the reference modified image signals found from the lookup table.

However, the target transmittance level might not be obtained by the above-described method. In this case, a predetermined voltage such as an a voltage that is lower than the target data voltage of a pixel at the previous frame is pre-applied to the pixel to pre-tilt the LC molecules. Then, the target data voltage is applied to the pixel at the present frame.

For this purpose, the signal controller 600 or an image signal modifier modifies a current image signal $g_N$ while taking into account the image signal of the next frame (referred to as a "next image signal" hereinafter) as well as a previous image signal $g_{N-1}$, to generate a modified current image signal (referred to as a "second modified image signal) $g_N$". For example, if the next image signal is dramatically different from the current image signal $g_N$, the current image signal $g_N$ is modified to prepare for the next frame even though the current image signal $g_N$ is substantially equal to the previous image signal $g_{N-1}$.

At this time, the second modified image signal $g_N''$ may be represented as a function F2 described in Equation 2. In this case, a frame memory is required for storing the previous image signal $g_{N-1}$, and the current image signal $g_N$ and a lookup table are used for storing the modified image signals with respect to pairs of the previous and current image signals $g_{N-1}$ and $g_N$.

Alternatively, a lookup table may be further required for storing the modified image signals with respect to pairs of the current and next image signals $g_N$ and $g_{N+1}$.

$$g_N''=F2(g_N',g_{N+1}) \quad \text{[Equation 2]}$$

The modification of the image signals and the data voltages may or may not be performed for the highest gray or the lowest gray. In order to modify the highest gray or the lowest gray, the range of the gray voltages generated by the gray voltage generator 800 may be widened compared to the range of the target data voltages for obtaining the range of the target luminance (or the target transmittance level) represented by the grays of the image signals.

Next, for modifying the image signals as described above, an image signal modifier of an LCD according to an exemplary embodiment of the present invention will be described with reference to FIGS. 3 to 5.

Figure 3:
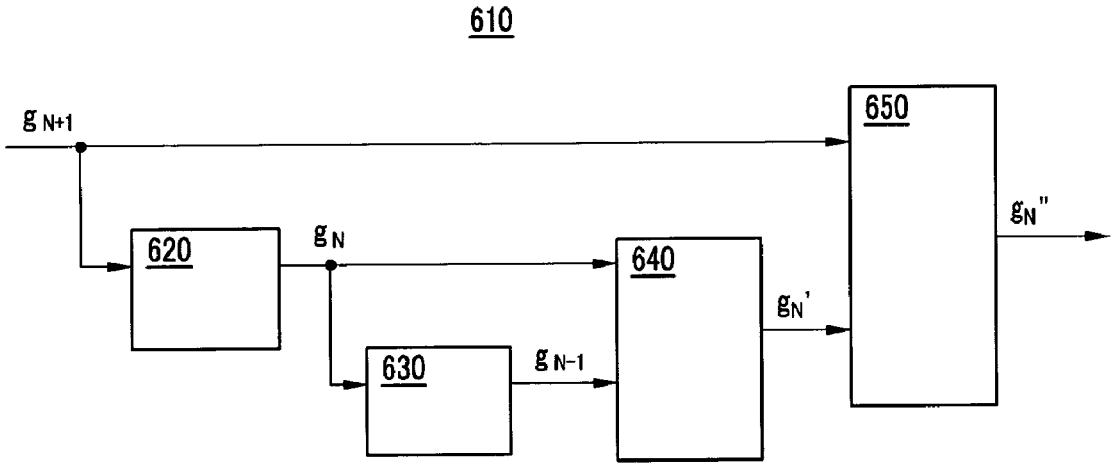
FIG. 3 is a block diagram of an image signal modifier of an LCD according to an embodiment of the present invention.
Figure 4:
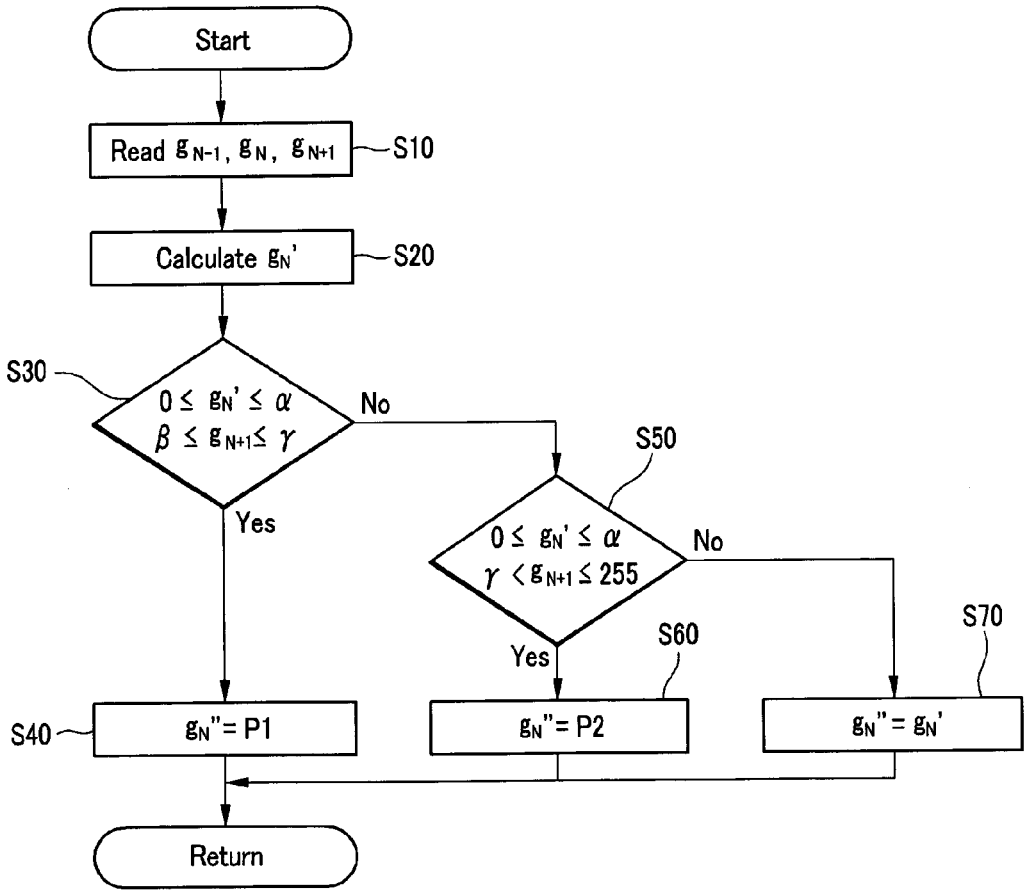
FIG. 4 is a flow chart indicating the operations of the image signal modifier shown in FIG. 3.
Figure 5:
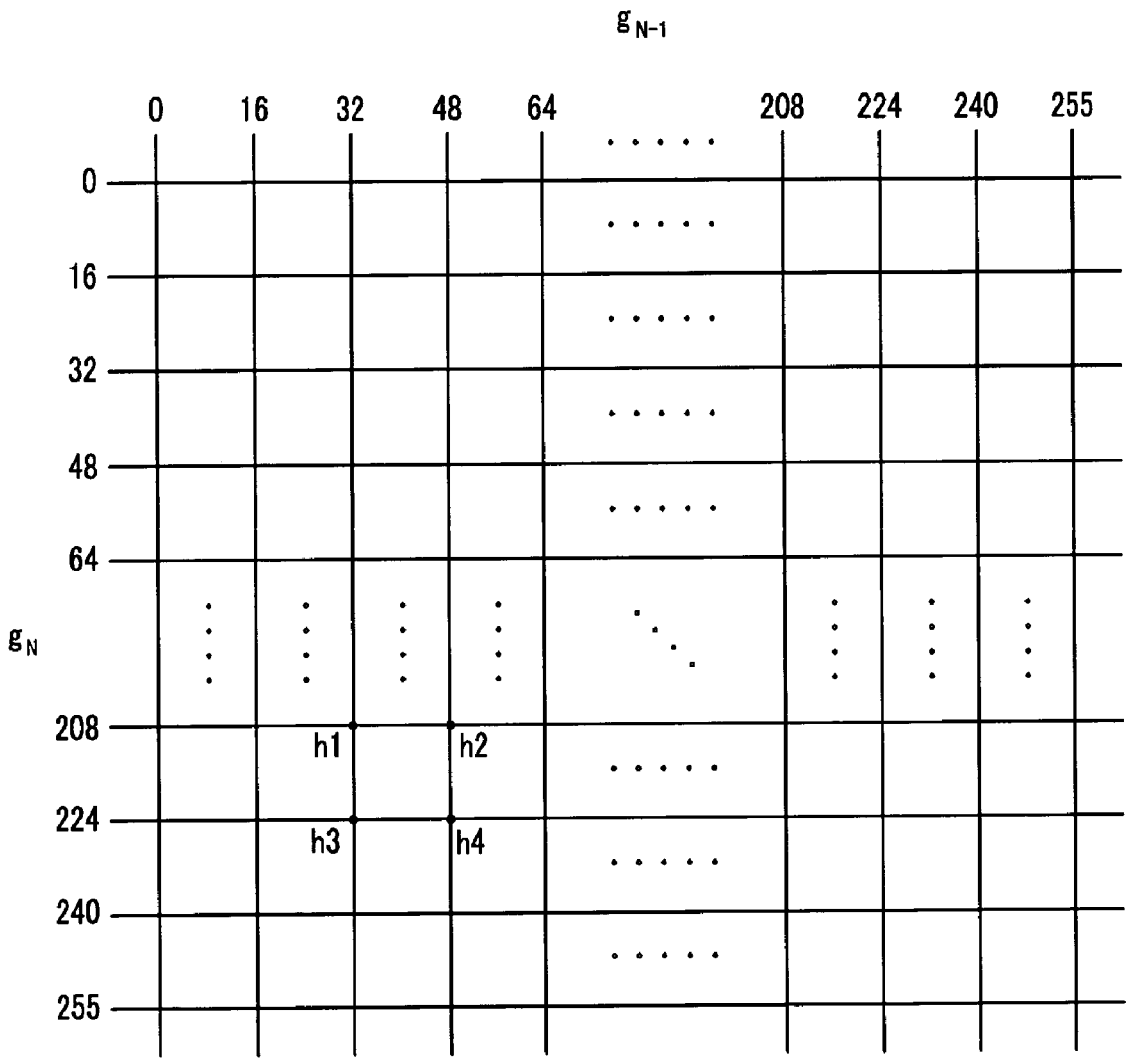
FIG. 5 is a schematic diagram for explaining an image signal modifying method according to an exemplary embodiment of the present invention.

FIG. 3 is a block diagram of an image signal modifier of an LCD according to an embodiment of the present invention, FIG. 4 is a flow chart indicating the operations of the image signal modifier shown in FIG. 3, and FIG. 5 is a schematic diagram for explaining an image signal modifying method according to an exemplary embodiment of the present invention.

As shown in FIG. 3, an image signal modifier 610 according to an exemplary embodiment of the present invention includes a first memory 620 connected to a next image signal $g_{N+1}$, a second memory 630 connected to the first memory 620, a first modifier 640 connected to the first and second memories 620 and 630, and a second modifier 650 connected to the next image signal $g_{N+1}$ and the first modifier 640. All or part of the circuit element of the image signal modifier 610 may be included in the signal controller 600 of FIG. 1, or may be implemented as a separate apparatus.

The first memory 620 transmits a current image signal $g_N$ to the second memory 630 and the first modifier 640, and receives the inputted next image signal $g_{N+1}$ to store as the current image signal of the next frame.

The second memory 630 transmits the stored previous image signal $g_{N-1}$ therein to the first modifier 640, and receives the current image signal $g_N$ from the first memory 620 to store as the previous image signal for the next frame.

Here, the first memory 620 is separated from the second memory 630. One memory may store the previous and current image signal $g_{N-1}$ and $g_N$ and apply them to the first modifier 640, and receive the inputted next image signal $g_{N+1}$ for storage.

The first modifier 640 includes a lookup table (not shown) and calculates a first modified image signal $g_N$, based on the previous and current image signal $g_{N-1}$ and $g_N$ from the second and first memory 630 and 620. The first modified image signal $g_N'$, is output to the second modifier 650.

As described above, the lookup table stores the reference modified image signals with respect to the previous and current image signals $g_{N-1}$ and $g_N$.

The second modifier 650 calculates the second modified signal $g_N''$ based on the next image signal $g_{N+1}$ and the first modified image signal $g_N'$ from the first modifier 640. The second modifier 650 outputs the second modified signal $g_N''$.

Next, the operations of the first and second modifiers 640 and 650 will be described in detail.

Referring to FIG. 4, when the operation starts, the first modifier 640 reads current and previous image signals $g_N$ and $g_{N-1}$ from the first and second memories 620 and 630, respectively, and the second modifier 650 reads a next image signal $g_{N+1}$ from an external device (S10).

Then, the first modifier 640 reads out a plurality of the reference modified image signals corresponding to pairs of the read previous and current image signals $g_{N-1}$ and $g_N$ from the lookup table and generates the first modified image signal $g_N'$ using the interpolation etc. along with the previous and current image signals $g_{N-1}$ and $g_N$ (S20).

FIG. 5 illustrates an exemplary method of modifying an image signal. When an image signal is 8-bits, there are 256 grays ($=2^8$). In the example that is shown, there are 17×17 reference modified image signals with respect to pairs of the previous and current image signals $g_{N-1}$ and $g_N$, wherein the 17 previous image signals $g_{N-1}$ and the 17 current images signals $g_N$ are each separated by a unit of 16 grays (0, 16, 32, . . . ). The reference modified image signals are stored in the lookup table. Where a pair of the previous and current image signals $g_{N-1}$ and $g_N$ is read as (36, 218), the first modifier 640 extracts the reference modified image signals $h_1$, $h_2$, $h_3$, and $h_4$ with respect to each of the pairs of the previous and current image signals (32, 208), (32, 224), (48, 208), (48, 224) from the lookup table and linearly-interpolates between them to calculate the first modified image signal $g_N'$.

The reference modified image signals are obtained empirically. Of course, the number of bits and the number of the grays corresponding to the reference modified image signals may be varied.

In the meantime, for applying a voltage higher than the maximum target data voltage (hereinafter, referred to as an "overshoot voltage"), the input image signal having a gray level of 255 is modified into the input image signal having a gray level of 254. Therefore, the modified image signal having a gray level of 254 corresponds to the maximum target data voltage and the image signal having a gray level of 255 corresponds to the overshoot voltage.

The second modifier 650 compares the value of the first modified image signal $g_N'$ from the first modifier 640 with a predetermined value α, and compares the value of the next image signal $g_{N+1}$ with predetermined values β and γ (S30, S50).

When the value of the first modified image signal $g_N'$ is less than the predetermined value α, and the value of the next image signal $g_{N+1}$ is more than the predetermined value β, but is less than the predetermined value γ, a value of the second modified image signal $g_N''$ is defined as a modification value P1 (S40).

When the value of the first modified image signal $g_N'$ is less than the predetermined value α and the value of the next image signal $g_{N+1}$ is more than the predetermined value γ but no larger than 255, the value of the second modified image signal $g_N''$ is defined as a modification value P2 (S60).

However, when the values of the image signals $g_N'$ and $g_{N+1}$ do not fulfill the conditions prescribed in the stages S50 and S60, the value of the second modified image signal $g_N''$ is set to be equal to that of the first modified image signal $g_N'$ (S70).

After defining the value of the second modified image signal $g_N''$ as described above, the operations are repeated.

Here, the modification values P1 and P2 are larger than the value of the first modified image signal $g_N'$. The modification values P1 and P2 are used for pre-tilting of the liquid crystals.

The predetermined value α is an upper threshold value for the first modified image signal $g_N'$, and the predetermined value β is the lower threshold value of the next image signal $g_{N+1}$, to achieve the proper amount of pre-tilting. The predetermined value γ is a reference value of the next image signal $g_{N+1}$ for defining the modification values P1 and P2. The predetermined values α, β, and γ and the modification values P1 and P2 may be determined empirically.

Next, an operation for generating the second modified image signal with respect to the input image signal by the image signal modifier 610 according to an exemplary embodiment of the present invention will be described with reference to FIG. 6.

Figure 6:
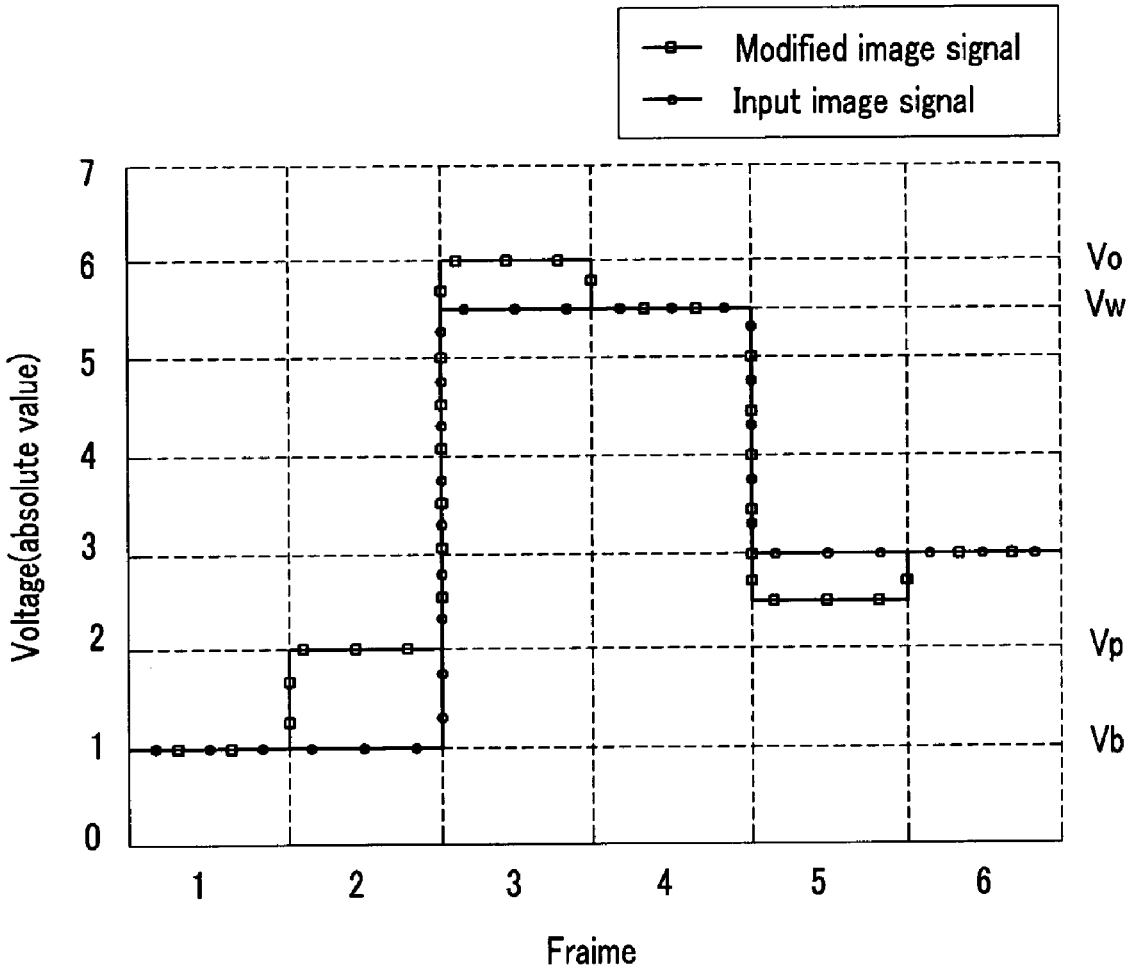
FIG. 6 is a waveform diagram illustrating modified signals according to an exemplary embodiment of the present invention.

FIG. 6 is a waveform diagram illustrating modified signals according to an exemplary embodiment of the present invention.

As shown in FIG. 6, the gray voltage corresponding to the input image signal is about 1 V in the first and second frames, about 5.5V in the third and fourth frames, and about 3V in the fifth and sixth frames.

In the case illustrated in FIG. 6, it is assumed that the LCD is a normally-black type. Accordingly, 1 V corresponds to a black gray voltage Vb, and 5.5 V corresponds to a white gray voltage Vw. Since an image signal is a digital signal that directly corresponds to a gray voltage, the image signal is herein used interchangeably with the gray voltage. Although the polarity of the gray voltage may be reversed, the gray voltage is herein expressed as an absolute value for simplicity of description.

The first modifier 640 modifies the input image signal so that the first modified image signal in the third frame is about 6 V. As described above, this modification is based on the difference between the input image signals in the second and third frames. The first modifier 640 modifies the first modified image signal in the fifth frame to be about 2.5 V based on the difference between the input image signals in the fourth and fifth frames.

Since the input image signals in the second, fourth, and sixth frames are equal to the respective preceding frames, the first modified image signals in the fourth and sixth frames are equal to those of the corresponding input image signals, respectively.

For example, when voltages corresponding to the predetermined values α, β, and γ are about 1.4 V, 4.5 V, and 5 V and voltages corresponding to the modification values P1 and P2 are about 1.7 V and 2 V, respectively, the second modifier 650 sets the second modified image signal in the second frame to be about 2 V and the second modified image signals in the remaining frames to be a value equal to the first modified image signal. As a result, the final second modified image signal is about 1 V in the first frame, about 2 V in the second frame, about 6 V in the third frame, about 5.5 V in the fourth frame, about 2.5 V in the fifth frame, and about 3 V in the sixth frame. The second modified image signal in the second frame is obtained though the stage S60 in FIG. 5.

The voltage Vp corresponding to the respective modification values P1 and P2 (hereinafter, referred to as "pre-tilt voltages") pre-tilts the liquid crystals to prepare for operations in the next frame. The maximum gray voltage Vo generated by the gray voltage generator 800 is used as the overshoot voltage and is larger than the white gray voltage Vw. The white gray voltage Vw is the maximum target data voltage.

Thereby, when the second modified image signal of about 2 V is applied to the pixels in the second frame, the liquid crystals are pre-tilted to enable rapid reaching of a target light transmittance for the white gray voltage Vw in the third frame.

The numerical values in the above-described embodiment of the present invention are examples, and they may be varied depending on characteristics of the LCD.

A method for defining the modification values P1 and P2 will be described with reference to FIG. 7.

Figure 7:
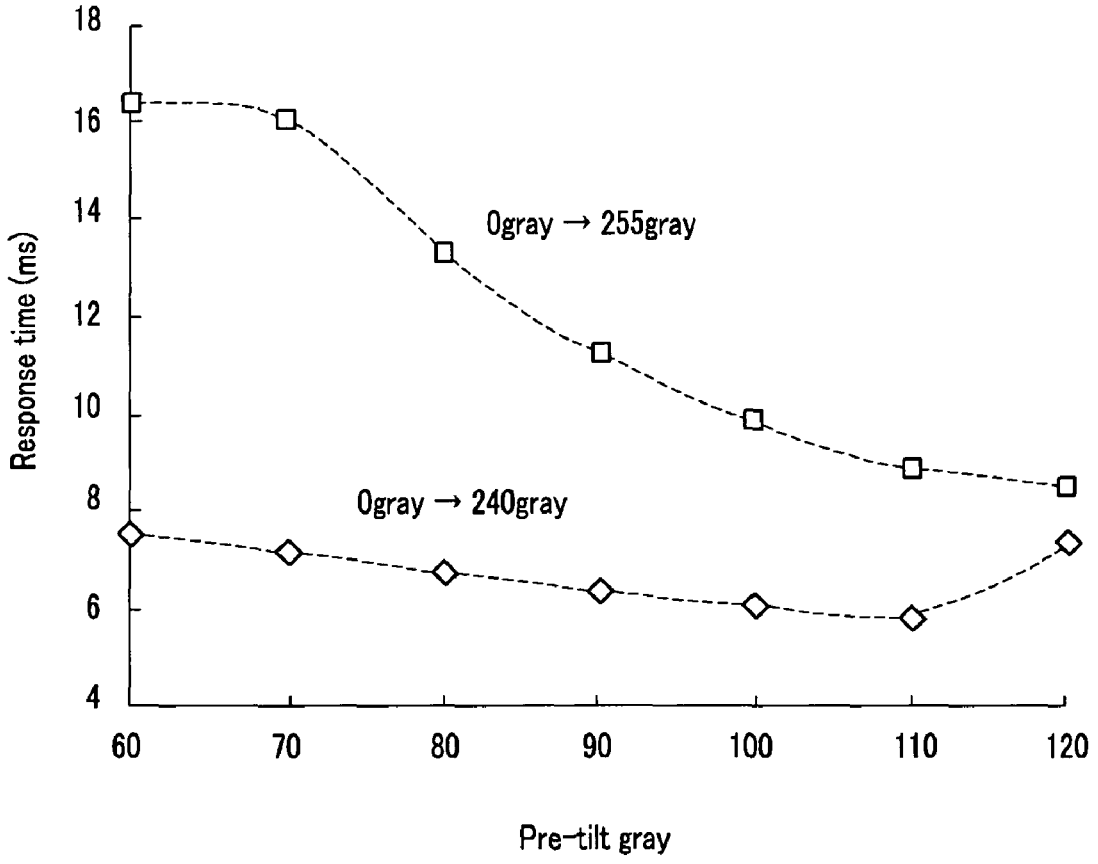
FIG. 7 shows graph curves of response time with respect to pre-tilt grays of an LCD according to an exemplary embodiment of the present invention.

FIG. 7 is a graph of response time as a function of pre-tilt grays of an LCD according to an exemplary embodiment of the present invention.

In the graph of FIG. 7, the X axis represents pre-tilt grays that correspond to the respective pre-tilt voltages, and the Y axis represents the response time for reaching the target light transmittance level.

The predetermined value γ has a gray level of 240.

The upper curve in FIG. 7 represents the response time with respect to the pre-tilt grays having a value between 60 and 120 when the first modified image signal has a 0 gray level and the next image signal has a gray level of 255.

The above case corresponds to the operation of the stage S60 in FIG. 4.

As the pre-tilt gray level becomes higher, the response time becomes shorter. Therefore, it is preferable that the pre-tilt gray level for satisfying the minimum response time, that is, the modification value P2, is set at least approximately 100.

The lower curve in FIG. 7 represents the response time with respect to the pre-tilt gray levels having a value between 60 and 120 when the first modified image signal has a gray level of 0 and the next image signal has a gray level of 240.

This case corresponds to the operation of the stage S40 in FIG. 4 where the predetermined value γ corresponds to a gray level of 240.

Like the upper curve, as the pre-tilt gray level becomes higher, the response time becomes shorter in the case of the lower curve. However, when the pre-tilt gray level increases beyond 110, the response time lengthens. This lengthening of the response time at a pre-tile gray level above 110 indicates that excessive pre-tilt gray may cause distortion of light transmittance. As this distortion could cause degradation in the quality of motion images, it is preferable that the pre-tilt gray level, that is, the modification value P1, is set at a value between about 60 and about 110 for optimum response time and image quality.

The predetermined value δ may be set at a value other than the gray level of 240.

If the pre-tilt gray is fixed at a particular value, it is difficult to minimize the response time and the deterioration of the image quality since the response time varies with the magnitude of the next image signal. The pre-tilt gray level is set by selecting one of two values to minimize the response time without deteriorating the image quality, and the selection depends on the magnitude of the next image signal. Since the magnitude of the next image signal is taken into account in setting the pre-tile gray level, response time is minimized and image quality is kept high regardless of the magnitude of the next image signal.

Instead of the minimizing of the response time, the difference between the overshoot voltage and the maximum target data voltage may be decreased to satisfying a target response time. This way, the maximum target data voltage is increased, and luminance relatively increases.

Next, the operation of the image signal modifier of an LCD according to another exemplary embodiment of the present invention will be described with reference to FIGS. 8 and 9.

Figure 8:
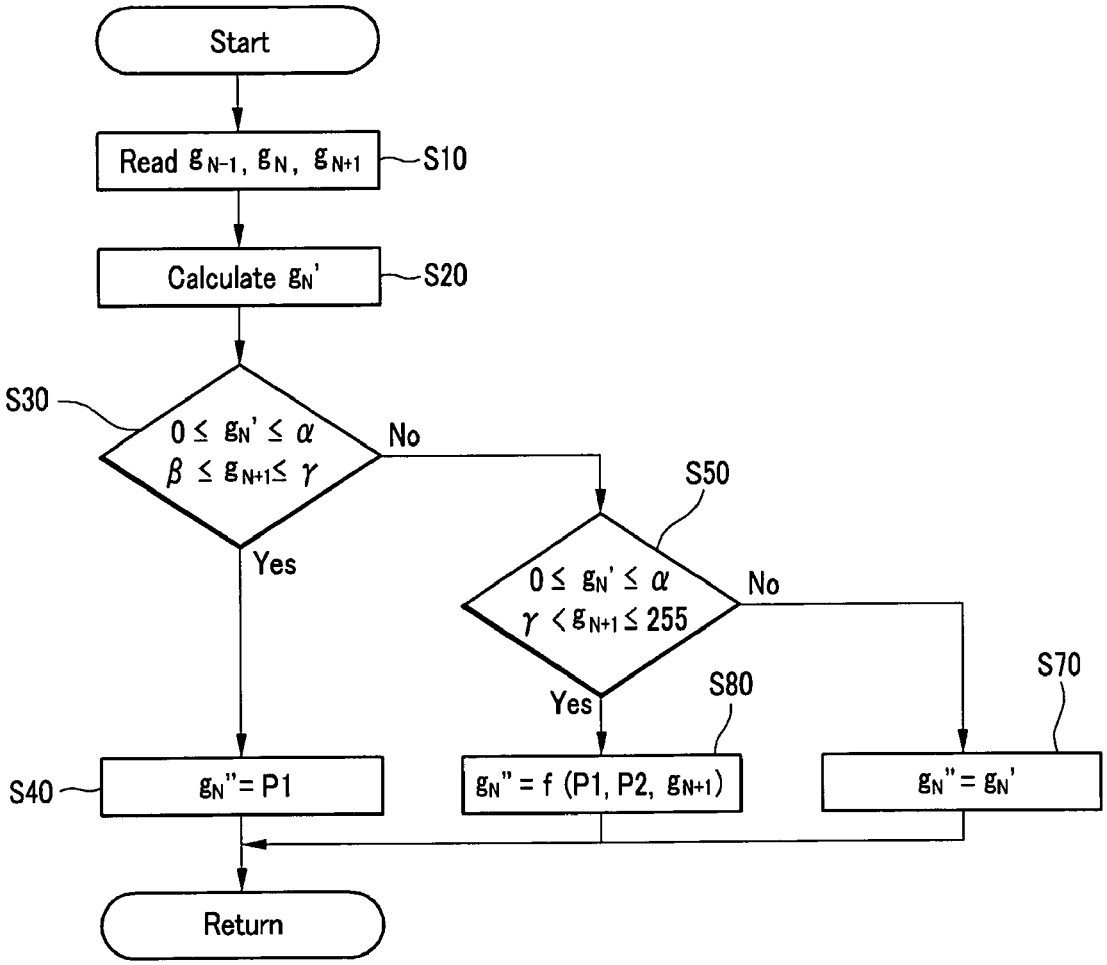
FIG. 8 is a flow chart of the image signal modifier show in FIG. 3.
Figure 9:
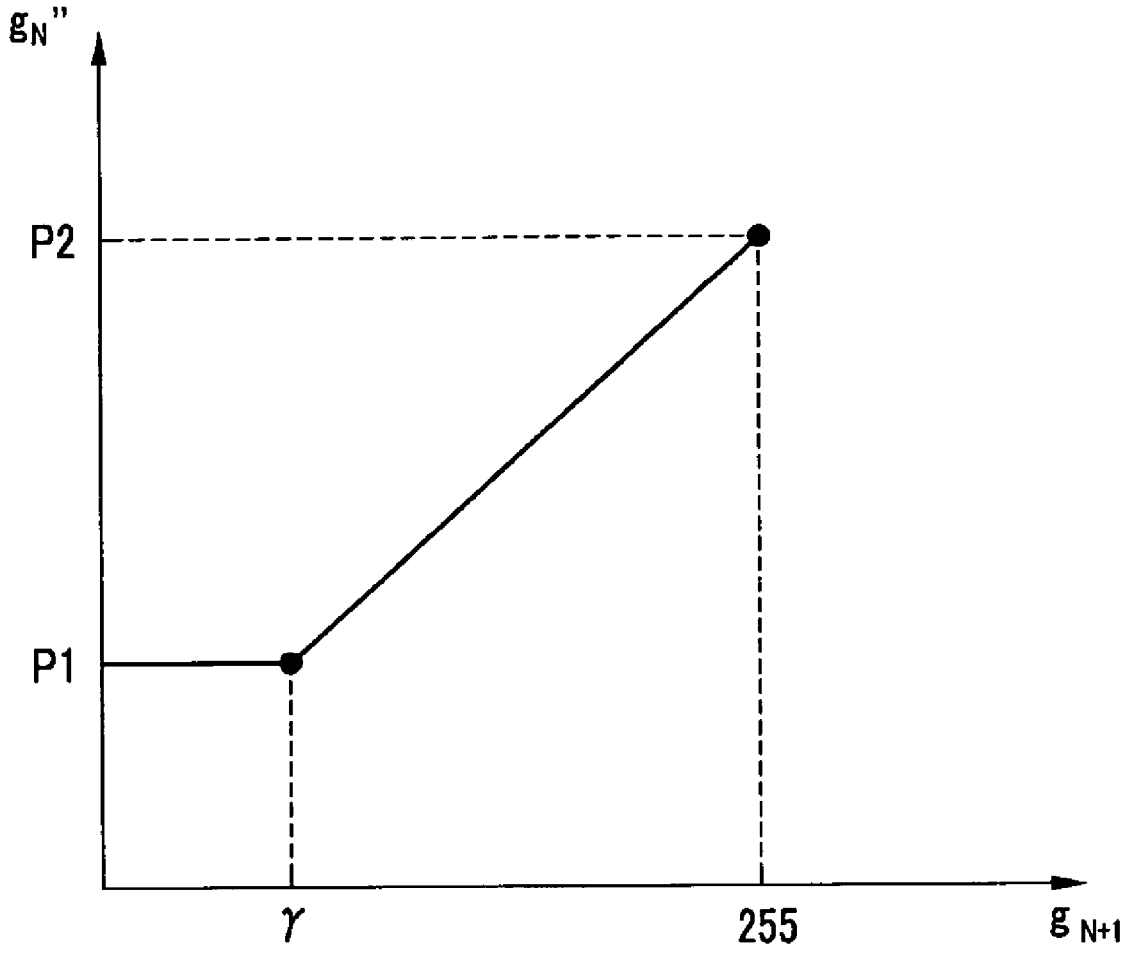
FIG. 9 is a schematic diagram for explaining a calculating method of a modified signal using interpolation.

FIG. 8 is a flow chart of the image signal modifier shown in FIG. 3, and FIG. 9 is a schematic diagram for explaining a calculating method of a modified signal using interpolation.

The operation of the image signal modifier according to this exemplary embodiment of the present invention is substantially the same as that of the image signal modifier 610 shown in FIG. 3 except for the method of calculating the second modified image signal $g_N''$. Therefore, the stages of operations are indicated by the same reference numerals as in FIG. 4 and their redundant detailed description is omitted.

In the flow chart in FIG. 8, the stage S60 in FIG. 4 is replaced with a stage S80.

When the second modifier 650 satisfies the condition of the stage S50, the second modified image signal $g_N''$ is calculated based on the modification values P1 and P2 and the next image signal $g_{N+1}$ as shown in Equation 3 (S80).

$$g_N''=f(P1,P2,g_{N+1}) \quad \text{[Equation 3]}$$

That is, in the exemplary embodiment of FIG. 9, when the next image signal $g_{N+1}$ is less than the predetermined value γ, the second modified image signal $g_N''$ has the modification value P1. However, when the next image signal $g_{N+1}$ is between the predetermined value γ and the maximum gray level 255, the second modified image signal $g_N''$ has a value obtained by linear-interpolation between the modification values P1 and P2.

Equation 4 is an example of the general Equation 3.

$$g_N''=[(P2-P1)/(255-\gamma)]\times(g_{N+1}-\gamma)+P1=A\times g_{N+1}+B \quad \text{[Equation 4]}$$

where A=(P2−P1)/(255−γ), B=P1−γ×(P2−P1)/(255−γ). The second modifier 650 may store constant values A and B in a separate memory (not shown) and perform the operation of Equation 4 using a shift register (not shown).

As described above, when the next image signal $g_{N+1}$ is greater than the predetermined value γ, the second modified image signal $g_N''$ and the pre-tilt gray level linearly vary.

Compared to the embodiment of FIG. 4, the response time with respect to the next image signal $g_{N+1}$ is less sensitive to a decrease in the predetermined value γ. This decreased sensitivity further improves image quality.

The interpolation used herein is not limited to linear interpolation. For example, an interval between the modification values P1 and P2 may be subdivided into a predetermined number, and each subdivided interval may be interpolated to calculate the second modified image signal $g_N''$.

According to the present invention, since the pre-tilt gray level is determined by one of two predetermined values or linearly varied depending on the input image signal, the response time is reduced without adverse effects on the image quality. Hence, luminance improves.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display comprising:

a plurality of pixels;

an image signal modifier that generates a preliminary signal based on a previous image signal and a current image signal and generates a modified image signal based on the preliminary signal and a next image signal; and a data driver that changes the modified image signal from the image signal modifier into a data voltage and supplies it to the pixels, wherein the modified image signal has at least two different values depending on a magnitude of the next image signal, wherein when the preliminary signal is less than a first predetermined value, and the next image signal is more than a second predetermined value and less than a third predetermined value, the modified image signal has a first modification value, and when the preliminary signal is less than the first predetermined value, and the next image signal is more than the third predetermined value, the modified image signal has a second modification value that is different from the first modification value, wherein the first predetermined value is an upper threshold of the preliminary signal, the second predetermined value is a lower threshold of the next image signal, and the third predetermined value is a reference value of the next image signal.

2. The display of claim 1, wherein when the preliminary signal is more than the first predetermined value or the next image signal is less than the second predetermined value, the modified image signal has a value equal to the preliminary signal.

3. The display of claim 1, wherein a difference between the preliminary signal and the previous image signal is greater than a difference between the current image signal and the previous image signal.

4. The display of claim 1, wherein the image signal modifier comprises:

a frame memory for storing the previous image signal and the current image signal, and a lookup table for storing a reference preliminary signal with respect to a pair of the previous image signal and the current image signal.

5. The display of claim 4, wherein the image signal modifier interpolates the reference preliminary signal to generate the preliminary signal.

6. A liquid crystal display comprising:

a plurality of pixels;

an image signal modifier that generates a preliminary signal based on a previous image signal and a current image signal and generates a modified image signal based on the preliminary signal and a next signal; and a data driver that changes the modified image signal from the image signal modifier into a data voltage and supplies it to the pixels, wherein the modified image signal has at least two different values depending on a magnitude of the next image signal, wherein when the preliminary signal is less than the first predetermined value, and the next image signal is more than the second predetermined value and less than the third predetermined value, the modified image signal has the first modification value, and when the preliminary signal is less than the first predetermined value and the next image signal is more than the third predetermined value, the modified image signal has a value that is interpolated between the first modification value and a second modification value that is different from the first modification value, wherein the first predetermined value is an upper threshold of the preliminary signal, the second predetermined value is a lower threshold of the next image signal, and the third predetermined value is a reference value of the next image signal.

7. The display of claim 6, wherein the image signal modifier interpolates based on Equation below:

$$P=[(P2-P1)/(m-\gamma)](x-\gamma)+P1=Ax+B$$

where P is the modified image signal, P1 and P2 are the first and second modification values, m is the maximum gray, γ is the third predetermined value, x is the next image signal, A=(P2−P1)/(m−γ), and B=P1−γ(P2−P1)/(m−γ).

8. The display of claim 7, wherein the image signal modifier comprises:

a storing device for storing the values A and B, and a shift register for operating the Equation.

9. The display of claim 6, wherein when the preliminary signal is more than the first predetermined value, or the next image signal is less than the second predetermined value, the modified image signal has a value equal to the preliminary signal.

10. A modifying method of an image signal of a liquid crystal display, the method comprising:

reading a previous image signal, a current image signal, and a next image signal;

generating a preliminary signal based on the previous image signal and the current image signal; and generating a modified image signal based on the preliminary signal and the next image signal, wherein the modified image signal has at least two different values depending to a magnitude of the next image signal, wherein the modified image signal generation comprises comparing the preliminary signal and the first predetermined value and comparing the next image signal and the second and third predetermined values, and generating the modified image signal based on a comparison result, and wherein when the preliminary signal is less than a first predetermined value, and the next image signal is more than a second predetermined value and less than a third predetermined value, the modified image signal has a first modification value, and when the preliminary signal is less than the first predetermined value and the next image signal is more than the third predetermined value, the modified image signal has a second modification value that is different from the first modification value, wherein the first predetermined value is an upper threshold of the preliminary signal, the second predetermined value is a lower threshold of the next image signal, and the third predetermined value is a reference value of the next image signal.

11. The method of claim 10, wherein when the preliminary signal is more than the first predetermined value or the next image signal is less than the second predetermined value, the modified image signal has a value equal to the preliminary signal.

12. The method of claim 10, wherein a difference between the preliminary signal and the previous image signal is greater than a difference between the current image signal and the previous image signal.

13. A modifying method of an image signal of a liquid crystal display, the method comprising:

reading a previous image signal, a current image signal, and a next image signal;

generating a preliminary signal based on the previous image signal and the current image signal; and generating a modified image signal based on the preliminary signal and the next image signal, wherein the modified image signal has at least two different values depending to a magnitude of the next image signal, wherein the modified image signal generation comprises comparing the preliminary signal and the first predetermined value and comparing the next image signal and the second and third predetermined values, and generating the modified image signal based on a comparison result, and wherein the modified image signal generation further comprises:

generating an interpolated value by interpolating between the first modification value and the second modification value depending on the comparison result;

when the preliminary signal is less than the first predetermined value and the next image signal is more than the second predetermined value and less than the third predetermined value, the modified image signal has the first modification value; and when the preliminary signal is less than the first predetermined value and the next image signal is more than the third predetermined value, the modified image signal has the interpolated value, wherein the first predetermined value is an upper threshold of the preliminary signal, the second predetermined value is a lower threshold of the next image signal, and the third predetermined value is a reference value of the next image signal.

14. The method of claim 13, wherein the interpolated value is calculated based on Equation below:

$$P=[(P2-P1)/(m-\gamma)](x-\gamma)+P1$$

where P is the interpolated value, P1 and P2 are the first and second modification values, respectively, m is the maximum gray, γ is the third predetermined value, and x is the next image signal.

* * * * *